US010987956B2

(12) United States Patent
Ota et al.

(10) Patent No.: US 10,987,956 B2
(45) Date of Patent: Apr. 27, 2021

(54) TRAY, ADAPTER, AND PRINTING APPARATUS

(71) Applicant: CANON KABUSHIKI KAISHA, Tokyo (JP)

(72) Inventors: Yasuhiro Ota, Chigasaki (JP); Koya Iwakura, Kawasaki (JP); Shimpei Fujisaki, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/526,882

(22) Filed: Jul. 30, 2019

(65) Prior Publication Data

US 2020/0039252 A1 Feb. 6, 2020

(30) Foreign Application Priority Data

Aug. 1, 2018 (JP) ..... JP2018-145041

(51) Int. Cl.
*B41J 11/58* (2006.01)
*B41J 11/02* (2006.01)

(52) U.S. Cl.
CPC ..... *B41J 11/58* (2013.01); *B41J 11/02* (2013.01)

(58) Field of Classification Search
None
See application file for complete search history.

(56) References Cited

U.S. PATENT DOCUMENTS 5,208,802 A 5/1993 Suzuki et al.
5,542,768 A 8/1996 Rother et al.
6,580,444 B1 6/2003 Drynkin et al.
6,893,176 B2 5/2005 Obara
2002/0106493 A1* 8/2002 Komuta ..... A45D 29/001 428/195.1
2002/0110399 A1* 8/2002 Murata ..... B41J 3/4071 400/615.2
2004/0061757 A1 4/2004 Yanagi et al.
(Continued)

FOREIGN PATENT DOCUMENTS

CN 1649739 A 8/2005
CN 1703322 A 11/2005
CN 101554805 A 10/2009
(Continued)

OTHER PUBLICATIONS

IP.com Search, InnovationQ Plus—IP.com, Jun. 11, 2020, pp. 1-2, https//iq.ip.com/discover.

*Primary Examiner* — Erica S Lin
(74) *Attorney, Agent, or Firm* — Canon U.S.A., Inc. I.P. Divison

(57) ABSTRACT

A tray for a printing apparatus including a conveying unit that conveys the tray holding a printing medium, and a printing unit that performs printing onto a print surface of the printing medium on the tray includes: a placement surface for placing thereon an adapter that holds the printing medium; a pressing member disposed on the upstream side of the adapter in the inserting direction of the tray with respect to the printing apparatus to press the adapter placed on the placement surface toward a downstream side of the inserting direction; a regulating portion configured to regulate a movement of the adapter by abutting the adapter pressed by the pressing member; and an opening into which a protrusion of the adapter is insertable.

20 Claims, 15 Drawing Sheets

(56) References Cited

U.S. PATENT DOCUMENTS

| | | | |
|---|---|---|---|
| 2004/0141791 | A1 | 7/2004 | Obara |
| 2005/0179709 | A1 | 8/2005 | Salisbury |

FOREIGN PATENT DOCUMENTS

| | | | |
|---|---|---|---|
| CN | 101654026 | A | 2/2010 |
| CN | 202062817 | U | 12/2011 |
| EP | 1057651 | A2 | 12/2000 |
| JP | H01-213858 | A | 8/1989 |
| JP | H07-98953 | A | 4/1995 |
| JP | 2000-011573 | A | 1/2000 |
| JP | 2000-132874 | A | 5/2000 |
| JP | 2017-213733 | A | 12/2017 |
| WO | 02065471 | A1 | 8/2002 |

* cited by examiner

TRAY, ADAPTER, AND PRINTING APPARATUS

BACKGROUND OF THE INVENTION

Field of the Invention

The present invention relates to a tray configured to hold a printing medium, an adapter to be placed on the tray, and a printing apparatus that uses the tray.

Description of the Related Art

There are printing apparatuses, such as copying machines and printers, in which, to perform printing onto a printing medium, such as an optical disc or a card that is thicker than a paper sheet, the printing medium is set on a tray and inserted into a printing apparatus body.

Japanese Patent Laid-Open No. 2017-213733 discloses a configuration in which an adapter that allows a printing medium, such as a card, to be placed thereon is placed on a tray to thereby enable borderless printing to be performed onto a printing medium, such as a card.

However, the adapter according to Japanese Patent Laid-Open No. 2017-213733 is formed of paper or the like that has an ink receiving layer so as to be able to absorb ink that hits a portion outside of a printing medium in borderless printing. The adapter formed of a paper sheet deforms as a result of the paper sheet warping and may easily float with respect to the tray.

SUMMARY OF THE INVENTION

Considering the aforementioned circumstance, the present invention provides a tray configured to reliably hold an adapter that allows a printing medium to be placed thereon.

To achieve the above, the present invention provides a tray that is to be used in a printing apparatus that includes a conveying unit configured to convey the tray that holds a printing medium, and a printing unit configured to perform printing onto a print surface of the printing medium held by the tray. The tray includes: a placement surface on which an adapter configured to hold the printing medium is to be placed; a pressing member that is disposed on an upstream side of the adapter in an inserting direction of the tray with respect to the printing apparatus and presses the adapter placed on the placement surface toward a downstream side of the inserting direction; a regulating portion configured to regulate a movement of the adapter by abutting the adapter pressed by the pressing member; and an opening into which a protrusion of the adapter is insertable.

Further features of the present invention will become apparent from the following description of exemplary embodiments with reference to the attached drawings.

DESCRIPTION OF THE EMBODIMENTS

Embodiments of a printing apparatus that uses a tray according to the present invention will be described. Note that components described in the embodiments are presented as examples and do not intend to limit the scope of the present invention. In the present specification, description will be provided by presenting, as an example, a serial-type inkjet printing apparatus that includes a printing head configured to discharge an ink with respect to a printing medium conveyed in an intermittent manner and that causes the printing head to reciprocate in a direction intersecting a conveying direction of the printing medium to perform printing. However, the present invention is not limited thereto and is applicable also to a line-type inkjet printing apparatus that uses a long print head to perform printing continuously. In the present specification, "ink" is used as a generic name of liquids, such as a printing liquid. In addition, in the present specification, "printing" is not limited to printing onto a planar object and includes printing onto a three-dimensional object. In the present specification, "printing medium" is used as a generic name of printing media onto which a liquid is discharged, the printing media including, for example, a paper sheet, a fabric, a plastic film, a metal plate, a glass, a ceramic, a wooden material, and a leather.

First Embodiment

Figure 1:
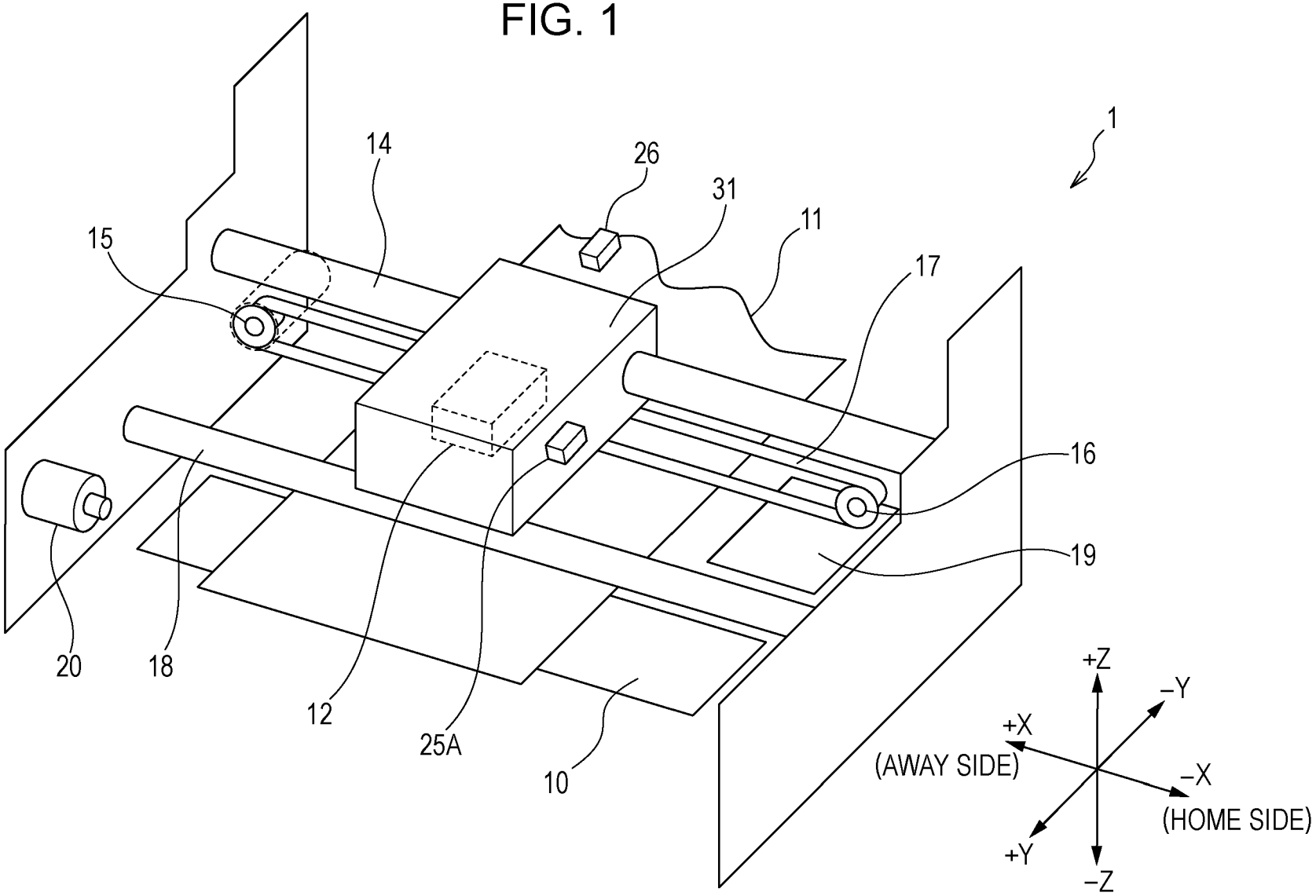
FIG. 1 is a schematic perspective view of a printing apparatus according to a first embodiment.

FIG. 1 is a schematic perspective view illustrating an internal configuration of a printing apparatus 1 according to the present embodiment. The printing apparatus 1 is loaded with a printing head 12 configured to discharge an ink with respect to a printing medium 11 and includes a carriage 31 configured to reciprocate in an X direction. The carriage 31 is guided and supported by a guide shaft 14 so as to be slidable in the X direction. A carriage motor 15 having a pulley is disposed at one end of an area in which the carriage 31 is movable, and an idler pulley 16 is disposed at the other end thereof. A timing belt 17 is stretched around the pulley of the carriage motor 15 and the idler pulley 16, and the carriage 31 and the timing belt 17 are thereby coupled to each other. A support member 18 that extends parallel to the guide shaft 14 is disposed on the downstream side in a +Y direction to suppress the carriage 31 from rotating about the guide shaft 14. The carriage 31 is slidably supported by the support member 18. The X direction is a direction in which the carriage 31 performs scanning and thus is also referred to as a main scanning direction in the following description.

The printing apparatus 1 includes, in the area in which the carriage 31 is movable and in a non-printing area in which printing operation by the printing head 12 is not performed, a maintenance mechanism 19 configured to perform maintenance of the printing head 12. The maintenance mechanism 19 includes, for example, a cap for sealing a discharge-port surface of the printing head 12 during a non-printing period, a wiper for wiping foreign materials and an excess ink adhering to the discharge-port surface, and the like. Hereinafter, a side on which the maintenance mechanism 19 is disposed in the X direction is referred to as a HOME side, and a side opposite to the HOME side is referred to as an AWAY side.

The printing apparatus 1 further includes a conveying unit that includes, for example, a first conveyance roller 13 and a second conveyance roller 22 (refer to FIG. 11) that are driven by a conveyance motor 20. The first conveyance roller 13 is disposed on the upstream side of the printing head 12 in the +Y direction. The second conveyance roller 22 is disposed on the downstream side of the printing head 12 in the +Y direction. The printing medium 11 is conveyed in the +Y direction, which intersects the X direction, by the conveying unit. In the present embodiment, the X direction and the Y direction are orthogonal to each other.

The printing apparatus 1 repeats a printing operation in which the printing head 12 discharges an ink while moving together with the carriage 31 in the X direction and an intermittent conveyance operation in which the conveying unit conveys the printing medium 11 in the Y direction, thereby printing an image onto the entire of the printing medium 11. The printing medium 11 conveyed by the conveying unit is supported at a lower surface thereof by a platen 10 that is disposed at a position opposite the printing head 12.

An edge sensor 26 configured to detect the printing medium 11 is disposed inside a conveyance route along which the printing medium 11 is conveyed by the conveying unit. In the present embodiment, the edge sensor 26 is disposed on the upstream side of the carriage 31 in the +Y direction. The edge sensor 26 may be of an optical type or of a mechanical type.

The printing apparatus 1 can perform printing onto, in addition to a printing medium, such as a paper sheet, a thin plate-shaped printing medium, such as a printable disc (hereinafter referred to as "disc"). To perform printing onto a thin plate-shaped printing medium, a user places the printing medium on a special tray 3 (refer to FIG. 3) to be held thereon and inserts the tray 3 into the printing apparatus 1 in a −Y direction, which is opposite a normal conveying direction (+Y direction). An optical sensor 25A configured to detect the tray 3 that is thus inserted by a user is attached to the carriage 31. The optical sensor 25A is a reflection-type sensor that includes a light emitter and a light receiver.

To perform printing that uses the tray 3, a user inserts the tray 3 between the second conveyance roller 22 and a spur and advances the tray 3 to a predetermined position. When the optical sensor 25A detects the tray 3 inserted to the predetermined position of the printing apparatus 1, the conveyance motor 20 is driven. In response to the driving of the conveyance motor 20, the first conveyance roller 13 and the second conveyance roller 22 rotate in a direction opposite the rotation direction for normally conveying the printing medium and convey the tray 3 in the −Y direction to a position opposite the printing head 12.

The printing apparatus 1 is thus configured to convey both a printing medium, such as a paper sheet, conveyed from the upstream side in the +Y direction and the tray 3 inserted from the downstream side (a side close to the second conveyance roller 22) in the +Y direction. The −Y direction opposite the +Y direction, which is the normal conveying direction, is a direction in which the tray 3 is inserted by a user and, hereinafter, also referred to as an inserting direction.

Figure 2:
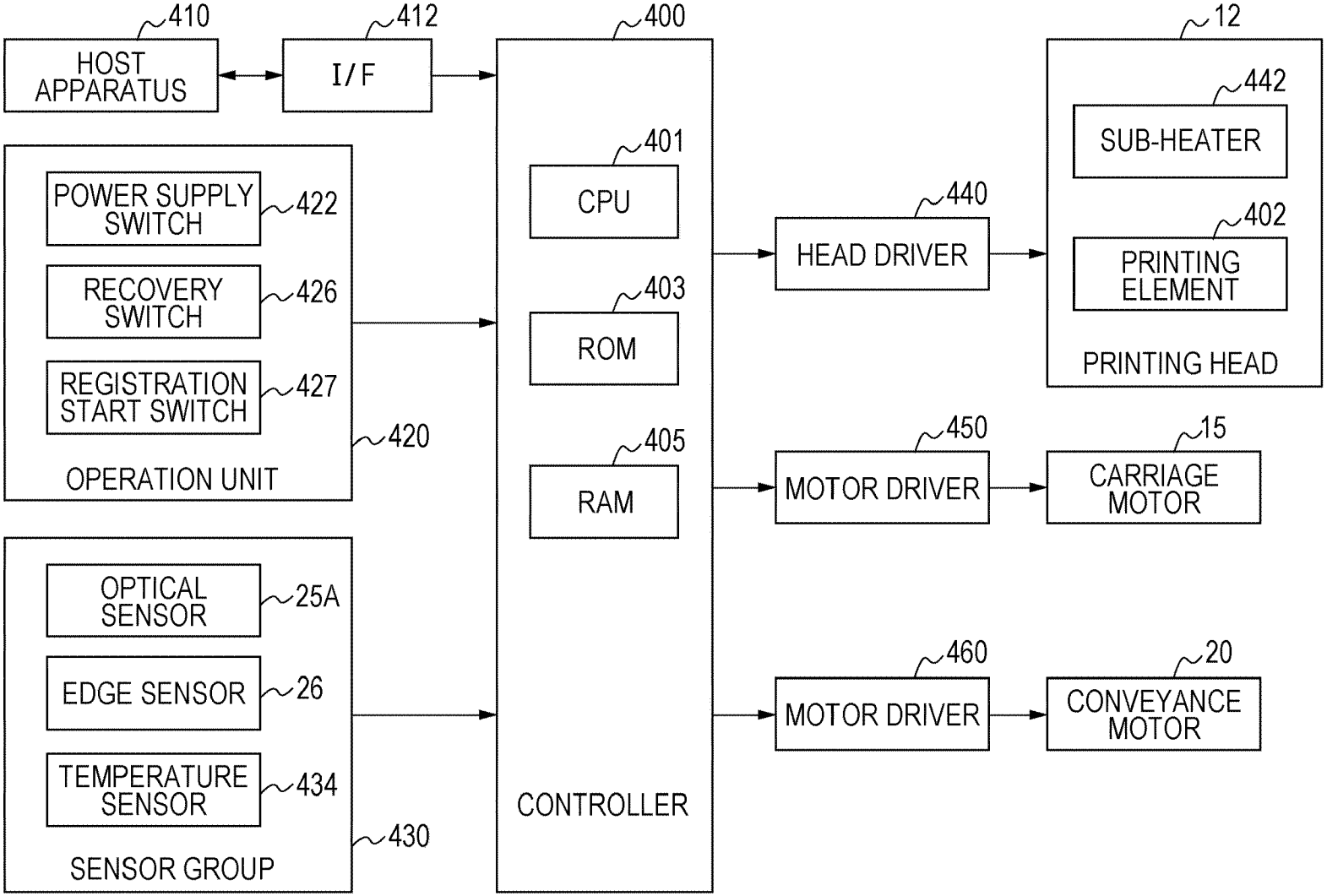
FIG. 2 is a block diagram illustrating a configuration of control of the printing apparatus according to the first embodiment.

FIG. 2 is a block diagram illustrating a configuration of control of the printing apparatus 1. A controller 400 includes a CPU 401 in the form of a micro-computer, a ROM 403 in which programs and other fixed data are stored, and a RAM 405 that includes an area in which image data is rasterized, a work area, and the like. A host apparatus 410 is an image-data supply source connected to the printing apparatus 1 and may be in the form of a personal computer (PC), an image-reading scanner, a digital camera, or the like configured to perform generation, processing, and the like of image data. Image data, other commands, status signals, and the like are transmitted to and received from the controller 400 via an interface (I/F) 412.

An operation unit 420 includes a plurality of switches configured to receive an instruction input by an operator. These switches include a power supply switch 422, a recovery switch 426 configured to provide an instruction to perform a maintenance operation for the printing head 12, and a registration start switch 427 for a user to input a command when executing a registration mode.

A sensor group 430 is configured by a plurality of sensors for detecting a state of the printing apparatus 1. These sensors include the optical sensor 25A loaded on the carriage 31, the edge sensor 26 configured to detect the printing medium 11 in the conveyance route, and a temperature sensor 434 disposed to detect an environment temperature.

A head driver 440 is a driver configured to drive the printing head 12. The printing head 12 includes a sub-heater 442 configured to perform temperature control to stabilize ink discharge characteristics and a printing element 402 to be used in printing. The sub-heater 442 is in a form of being formed, together with the printing element 402, on a substrate of the printing head 12 or a form of being attached to the body of the printing head 12 or to a head cartridge.

A motor driver 450 is a driver configured to drive the carriage motor 15. A motor driver 460 is a driver configured to drive the conveyance motor 20 that is used to convey the printing medium 11 and the tray 3.

Figure 3:
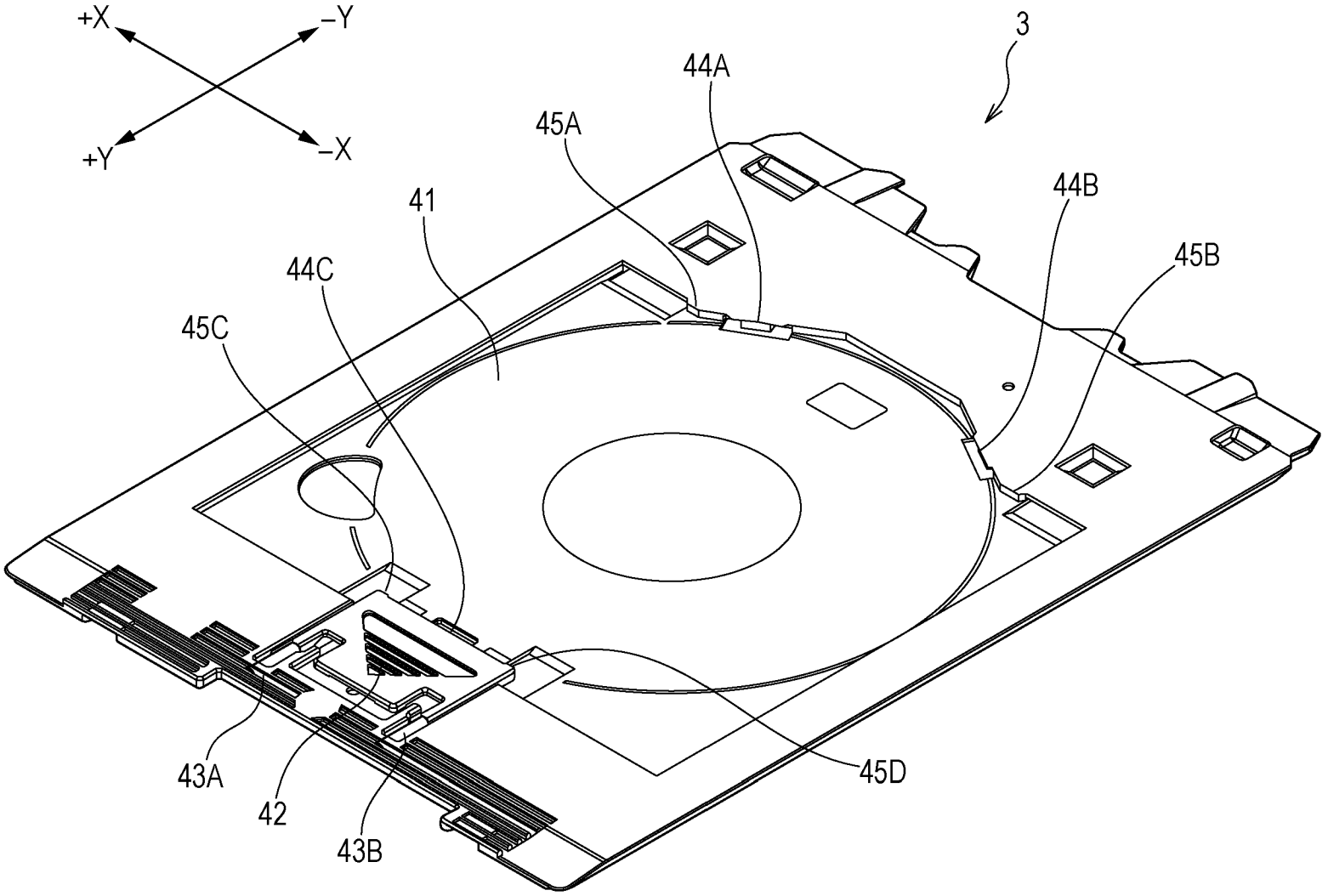
FIG. 3 is a perspective view of a tray that is to be used in the printing apparatus according to the first embodiment.

Next, with reference to FIG. 3, the tray 3 according to the present embodiment will be described. The tray 3 includes, mainly, a recessed portion 41 as a placement surface formed to be lower than the periphery thereof to allow a printing medium to be placed thereon, a slidable pressing member 42 that presses the printing medium 11 placed in the recessed portion 41, and elastic members 43A and 43B configured to urge the pressing member 42. The pressing member 42 is urged toward the downstream side in the inserting direction (−Y direction) of the tray 3 by the elastic members 43A and 43B. The tray 3 includes a first regulating portion 44 and a second regulating portion 45, against which a printing medium placed in the recessed portion 41 and pressed (urged) by the pressing member 42 is abutted to perform positioning of the printing medium.

The first regulating portion 44 is disposed at a position that enables, for example, a circular printing medium, such as a disc, to be abutted against the first regulating portion 44. The first regulating portion 44 includes downstream-side first regulating portions 44A and 44B and an upstream-side first regulating portion 44C. The downstream-side first regulating portions 44A and 44B are disposed, on the downstream side of the recessed portion 41 in the inserting direction (−Y direction) of the tray 3, obliquely in the inserting direction of the tray 3 (or in the longitudinal direction of the tray 3) so as to extend along the circular shape of the printing medium. The upstream-side first regulating portion 44C is disposed at a center portion of the pressing member 42 in the X direction, the pressing member 42 being disposed on the upstream side of the recessed portion 41 in the −Y direction.

The second regulating portion 45 is disposed at a position that enables a quadrangular printing medium, such as a later-described mount (adapter), to be abutted against the second regulating portion 45. The second regulating portion 45 includes downstream-side second regulating portions 45A and 45B and upstream-side second regulating portions 45C and 45D. The downstream-side second regulating portions 45A and 45B are disposed, on the downstream side of the recessed portion 41 in the inserting direction (−Y direction) of the tray 3, on the outer side of the first regulating portions 44A and 44B in the X direction. Each of the upstream-side second regulating portions 45C and 45D is disposed at a corresponding one of two end portions of the pressing member 42 in the X direction, the pressing member 42 being disposed on the upstream side of the recessed portion 41 in the −Y direction. In other words, the pressing member 42 is provided with the upstream-side first regulating portion 44C, against which a disc or the like can be abutted, between the upstream-side second regulating portions 45C and 45D.

Figure 4A:
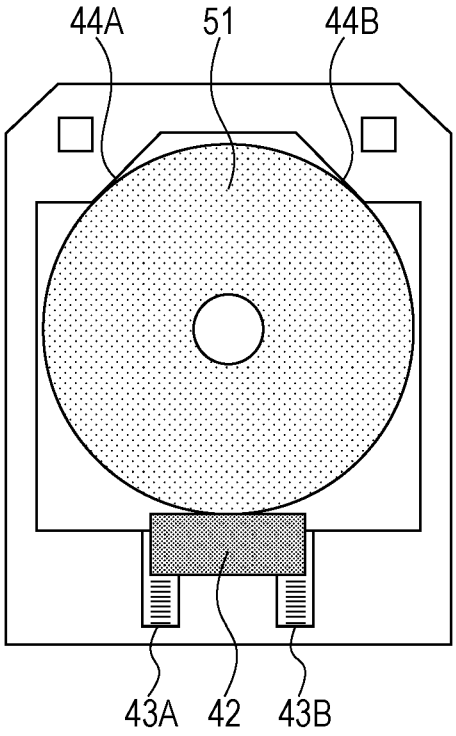
FIGS. 4A, 4B, 4C, and 4D are schematic top views each illustrating a state in which a printing medium is placed and held on the tray according to the first embodiment.

FIGS. 4A, 4B, 4C, and 4D are schematic top views each illustrating a state in which a printing medium is placed and held on the tray 3. FIG. 4A illustrates a state in which a disc 51, as a circular printing medium, is held. Examples of the disc are printable optical discs, such as a CD (compact disc), a DVD (digital versatile disc), and a BD (Blu-ray disc). When the disc 51 is held on the tray 3, an outer edge of the disc 51 is abutted against the downstream-side first regulating portions 44A and 44B and the upstream-side first regulating portion 44C, and positioning of the disc 51 is thereby performed. When the disc 51 is positioned on the tray 3, the disc 51 and each of the second regulating portions 45A to 45D do not abut on each other.

Figure 4B:
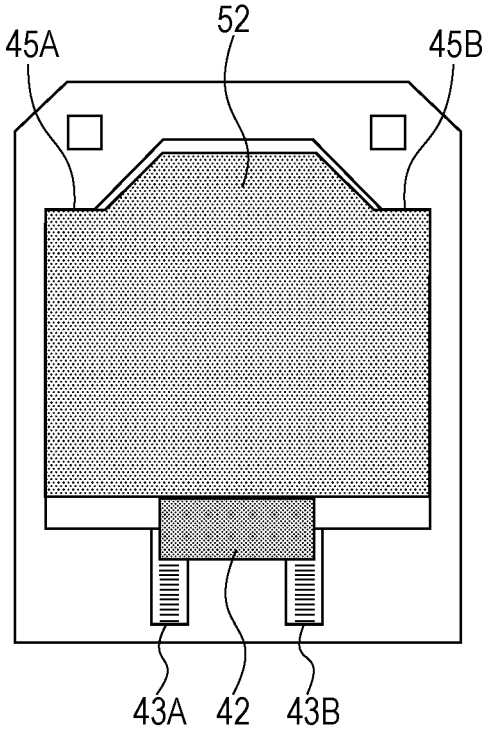

FIG. 4B illustrates a state of holding a mount 52 that has a shape corresponding to the shape of the recessed portion 41 of the tray 3 and that serves as an adapter that allows a printing medium to be placed thereon. When the mount 52 is held on the tray 3, the mount 52 and each of the second regulating portions 45A to 45D abut on each other, and positioning of the mount 52 is thereby performed. When the mount 52 is positioned on the tray 3, the mount 52 and each of the first regulating portions 44A to 44C do not abut on each other.

Figure 4C:
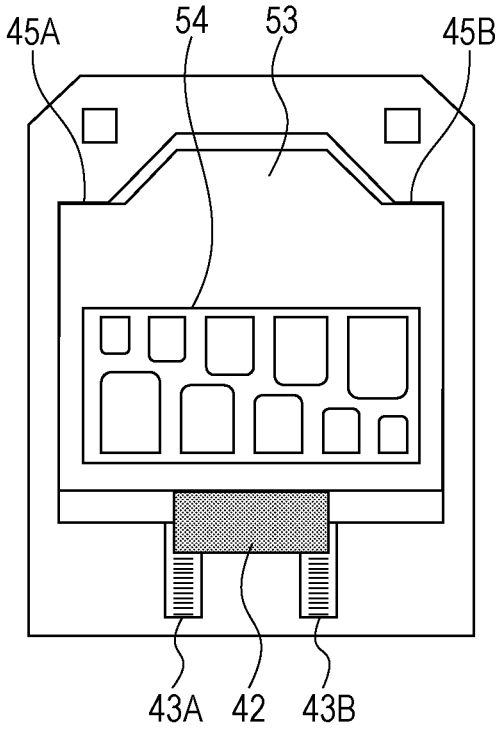
Figure 4D:
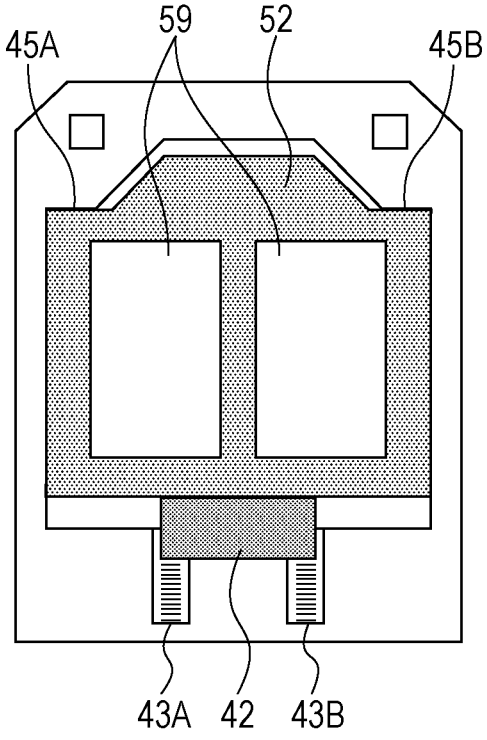

FIGS. 4C and 4D each illustrate an example of a printing medium onto which printing is to be performed using the mount 52. FIG. 4C illustrates a state in which the tray 3 holds a nail-sticker mount 53 that has a shape identical to the shape of the mount 52 illustrated in FIG. 4B. The nail-sticker mount 53 is a mount on which a printing surface 54 for a nail sticker is arranged. When the nail-sticker mount 53 is placed on the tray 3, the printing apparatus 1 is enabled to perform printing for a nail sticker with respect to the printing surface 54.

FIG. 4D illustrates a state of holding the mount 52 that includes a card placement surface 59 on which a card as a printing medium is to be placed. The card placement surface 59 is a recessed portion whose level is lower than the surface of the mount 52 and has a shape in accordance with the outer shape of the printing medium (card). A user can place a card on the card placement surface 59 with a print surface of the card facing upward. For example, a card or the like for which a regular size is prescribed in JIS or the like can be placed on the card placement surface 59. The depth of the recessed portion of the card placement surface 59 may be determined such that, in a state in which a card is placed on the card placement surface 59, the surface of the card and the surface of the mount 52 are substantially level with each other. Thus, in accordance with the thickness of a card, a through hole or a non-through hole having a predetermined depth is provided in the mount 52 to form the card placement surface 59.

To enable borderless printing using the mount 52 and the nail-sticker mount 53 with respect to a printing medium, such as a card or a nail sticker, at least the outer side of the printing medium may be formed by an ink receiving layer. The mount 52 and the nail-sticker mount 53 may be formed of plastic or the like. The nail sticker and the card are examples of a printing medium onto which printing is performed using the mount 52, and the present invention is not limited thereto. Hereinafter, the mount 52 will be described as an example for the configuration of each of the mount 52 and the nail-sticker mount 53. The configuration of the nail-sticker mount 53 is identical to the configuration of the mount 52.

Figure 5A:
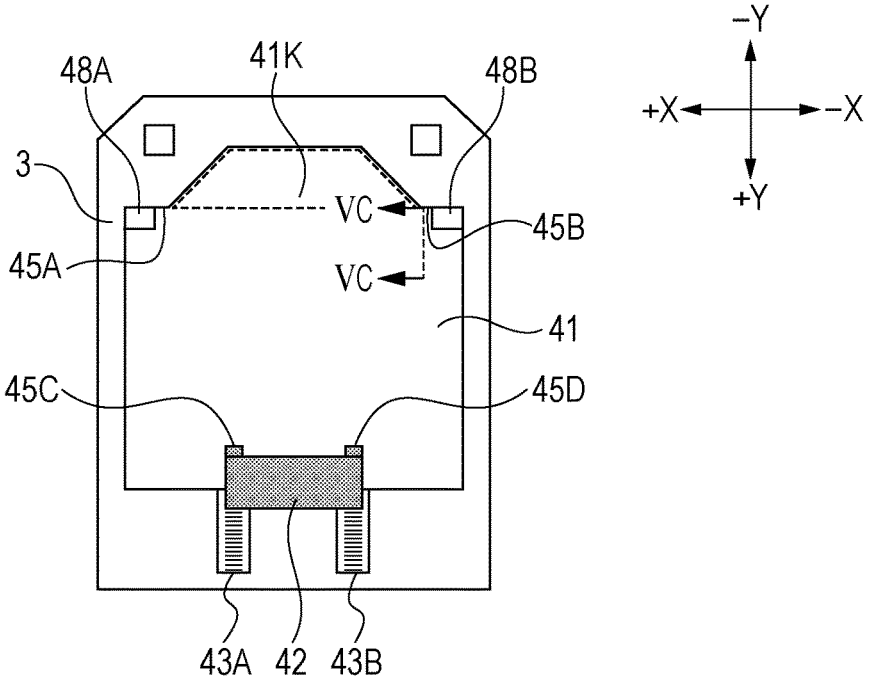
FIGS. 5A, 5B, and 5C each describe the detail of the tray according to the first embodiment and a mount.
Figure 5B:
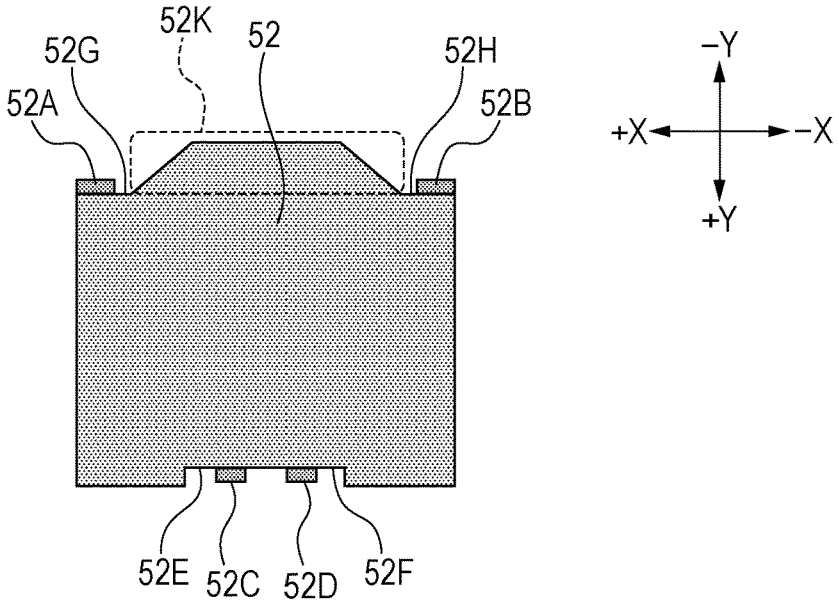
Figure 5C:
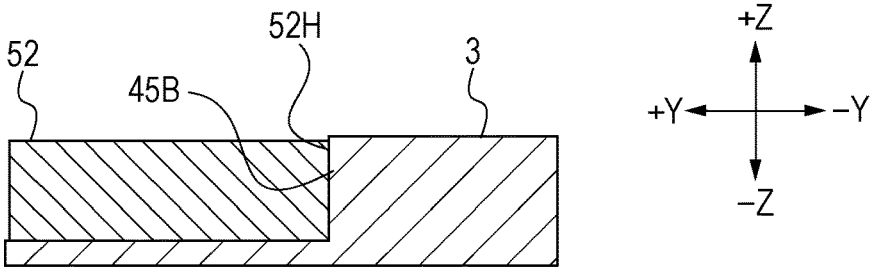

With reference to FIGS. 5A, 5B, and 5C, the detail of the tray 3 and the mount 52 will be described. FIG. 5A is a top view of the tray 3 on which the mount 52 is not placed. As described above, the tray 3 includes the downstream-side second regulating portions 45A and 45B and the upstream-side second regulating portions 45C and 45D. A first opening 48A is disposed at a position adjacent to the downstream-side second regulating portion 45A. A second opening 48B is disposed at a position adjacent to the downstream-side second regulating portion 45B.

FIG. 5B is a schematic top view of the mount 52. The mount 52 includes a first protrusion 52A that is to be inserted into the first opening 48A of the tray 3 and a second protrusion 52B that is to be inserted into the second opening 48B. As a result of the first protrusion 52A and the second protrusion 52B being respectively inserted into the first opening 48A and the second opening 48B, positioning of the mount 52 with respect to the tray 3 in the X direction is performed.

The mount 52 includes, on the inner side of the first protrusion 52A, a first abutting surface 52G against which the downstream-side second regulating portion 45A of the tray 3 is to be abutted and includes, on the inner side of the second protrusion 52B, a second abutting surface 52H against which the downstream-side second regulating portion 45B of the tray 3 is to be abutted. FIG. 5C is a sectional view taken along the line VC-VC of FIG. 5A. As a result of the mount 52 placed on the tray 3 being urged in the −Y direction by the pressing member 42, the downstream-side second regulating portion 45A and the first abutting surface 52G abut on each other, and the downstream-side second regulating portion 45B and the second abutting surface 52H abut on each other. FIG. 5C is a sectional view illustrating a state of abutting between the downstream-side second regulating portion 45B and the second abutting surface 52H. The state is identical to a state of abutting between the downstream-side second regulating portion 45A and the first abutting surface 52G. Consequently, positioning of the mount 52 with respect to the tray 3 is performed on the downstream side in the −Y direction.

The mount 52 further includes a third abutting surface 52E against which the upstream-side second regulating portion 45C of the pressing member 42 is to be abutted and a fourth abutting surface 52F against which the upstream-side second regulating portion 45D is to be abutted. A third protrusion 52C and a fourth protrusion 52D are disposed between the third abutting surface 52E and the fourth abutting surface 52F. The detail of the third protrusion 52C and the fourth protrusion 52D will be described later.

Figure 6A:
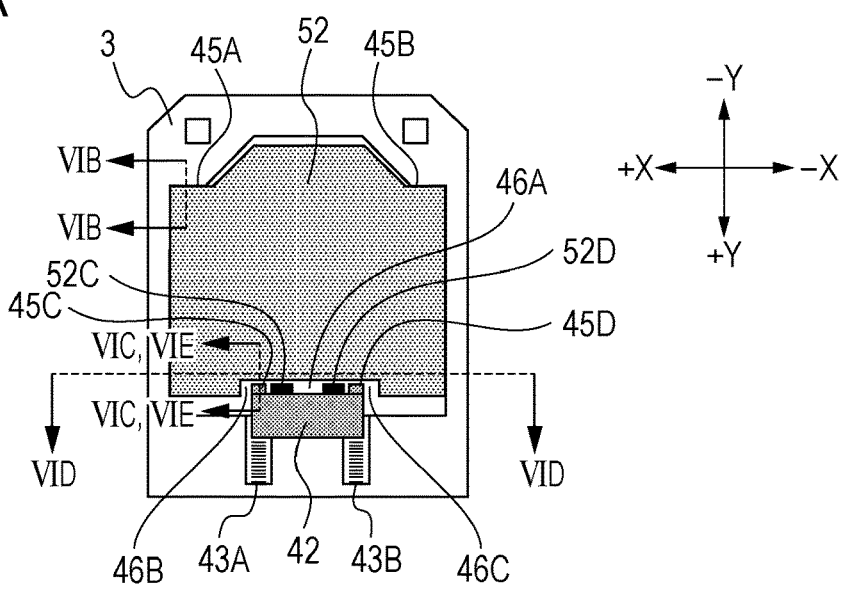
FIGS. 6A, 6B, 6C, 6D, and 6E each illustrate the detail of a state in which the mount according to the first embodiment is positioned on the tray.
Figure 6B:
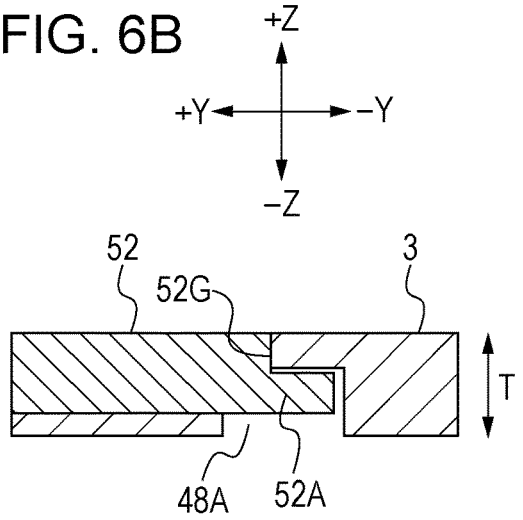

FIGS. 6A, 6B, 6C, 6D, and 6E each illustrate the detail of a state in which the mount 52 is positioned on the tray 3. FIG. 6A is a top view of the tray 3 that holds the mount 52. FIG. 6B is a schematic sectional view taken along the line VIB-VIB of FIG. 6A in a Z direction. The first protrusion 52A of the mount 52 is to be inserted into the first opening 48A and thus has a thickness smaller than the thicknesses of the other areas of the mount 52. As illustrated in FIG. 6B, the mount 52 is formed not to exceed a thickness T of the tray 3 in a state in which the first protrusion 52A is inserted into the first opening 48A. The second protrusion 52B is also similarly formed.

Figure 6C:
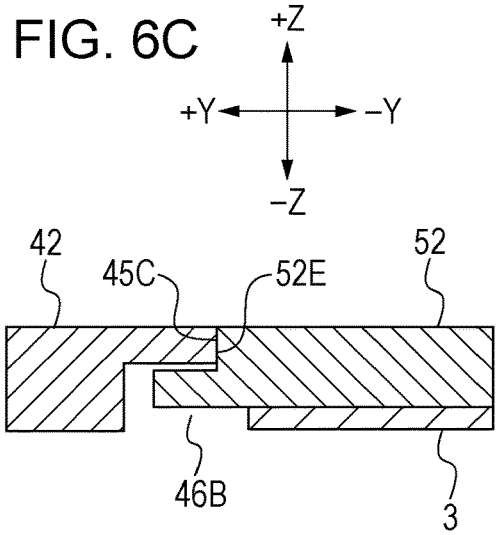

FIG. 6C is a sectional view taken along the line VIC-VIC of FIG. 6A in the Z direction. As a result of the upstream-side second regulating portion 45C and the third abutting surface 52E abutting on each other, positioning of the mount 52 with respect to the tray 3 is performed on the upstream side in the −Y direction. The tray 3 includes a fourth opening 46B in the vicinity of the upstream-side second regulating portion 45C. Consequently, an abutting area of the upstream-side second regulating portion 45C of the pressing member 42 is increased, which makes the tray 3 applicable to the mount 52 that has a different thickness. Abutting between the upstream-side second regulating portion 45D and the fourth abutting surface 52F has the same configuration, and a fifth opening 46C is disposed in the vicinity of the upstream-side second regulating portion 45D (refer to FIG. 6A).

Figure 6D:
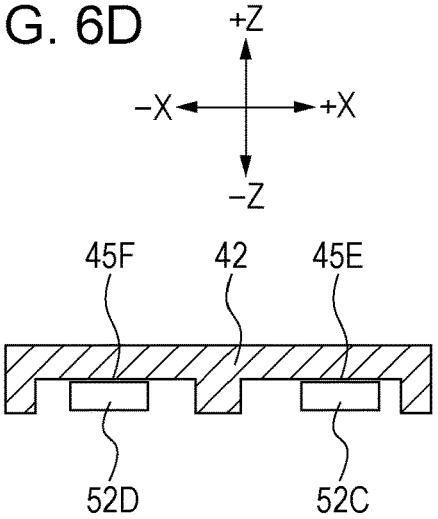

FIG. 6D is a sectional view taken along the line VID-VID of FIG. 6A and viewed from the downstream side in the inserting direction (−Y direction). The third protrusion 52C of the mount 52 is inserted into a first engaging portion 45E disposed in the pressing member 42. The fourth protrusion 52D of the mount 52 is inserted into a second engaging portion 45F disposed in the pressing member 42. Consequently, positioning in the Z direction is more reliably performed on the upstream side of the mount 52 in the −Y direction. In other words, it is possible to restrict a movement of the mount 52 in the Z direction.

In general, when the mount 52 is formed of paper or plastic, if a warp of the mount 52 is increased as a result of the mount 52 being deformed, the mount 52 floats from the tray 3, and there is a possibility of positioning being not performed suitably with respect to the tray 3. Moreover, if printing is performed in a state in which the mount 52 floats from the tray 3, the printing head 12 and a printing medium may come into contact with teach other.

In contrast, the tray 3 according to the present embodiment suppresses the mount 52 from floating, even when the warp of the mount 52 is large, by inserting the third protrusion 52C into the first engaging portion 45E and inserting the fourth protrusion 52D into the second engaging portion 45F. Similarly, the mount 52 is suppressed from floating also on the downstream side in the −Y direction by employing a configuration in which the first protrusion 52A and the second protrusion 52B are inserted into the first opening 48A and the second opening 48B, respectively, at left and right end portions in the X direction. In particular, floating as a result of the warp of the mount 52 is suppressed by employing a configuration in which the mount 52 is provided with the first protrusion 52A and the second protrusion 52B at two end portions thereof corresponding thereto in the width direction (X direction) and inserted with respect to the tray 3.

The tray 3 includes, in a range in which the pressing member 42 is slidable, a third opening 46A (refer to FIG. 6A) in an area between the third protrusion 52C and the fourth protrusion 52D when the mount 52 is placed on the tray 3. The third opening 46A is disposed in the vicinity of the upstream-side first regulating portion 44C (FIG. 3) against which the disc 51 is to be abutted and increases a clearance for insertion of the disc 51 by a user in the Z direction, which improves operability.

Figure 6E:
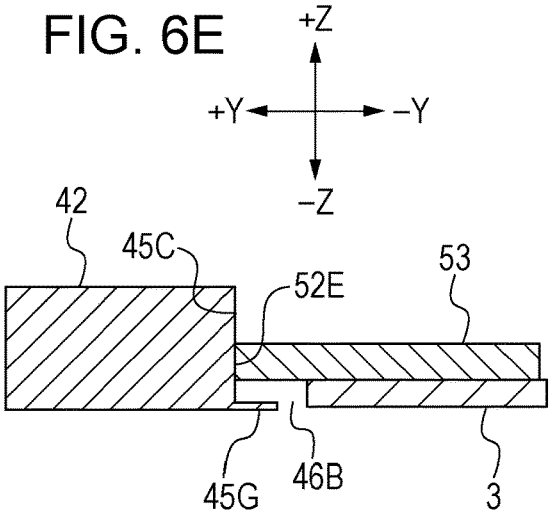

FIG. 6E illustrates a modification of the upstream-side second regulating portion 45C. Similarly to FIG. 6C, FIG. 6E is a sectional view taken along the line VIE-VIE of FIG. 6A. FIG. 6E illustrates a state in which a nail-sticker mount 53 that has a thickness smaller than the thickness of the mount 52 is placed on the tray 3. There is a possibility of the nail-sticker mount 53 being not suitably held on the tray 3 as a result of the nail-sticker mount 53 being inserted between the fourth opening 46B and the pressing member 42 during placing of the nail-sticker mount 53. Accordingly, the pressing member 42 includes a restriction portion 45G that extends in the −Y direction from a lower portion of the upstream-side second regulating portion 45C.

In the modification in FIG. 6E, when the nail-sticker mount 53 moves to be inserted into the fourth opening 46B, the nail-sticker mount 53 comes into contact with the restriction portion 45G, which restricts the insertion thereof. Consequently, erroneous setting of the nail-sticker mount 53 with respect to the tray 3 by a user is suppressed. The same effect is obtained by disposing a restriction portion 45H similarly at the upstream-side second regulating portion 45D.

Figure 7A:
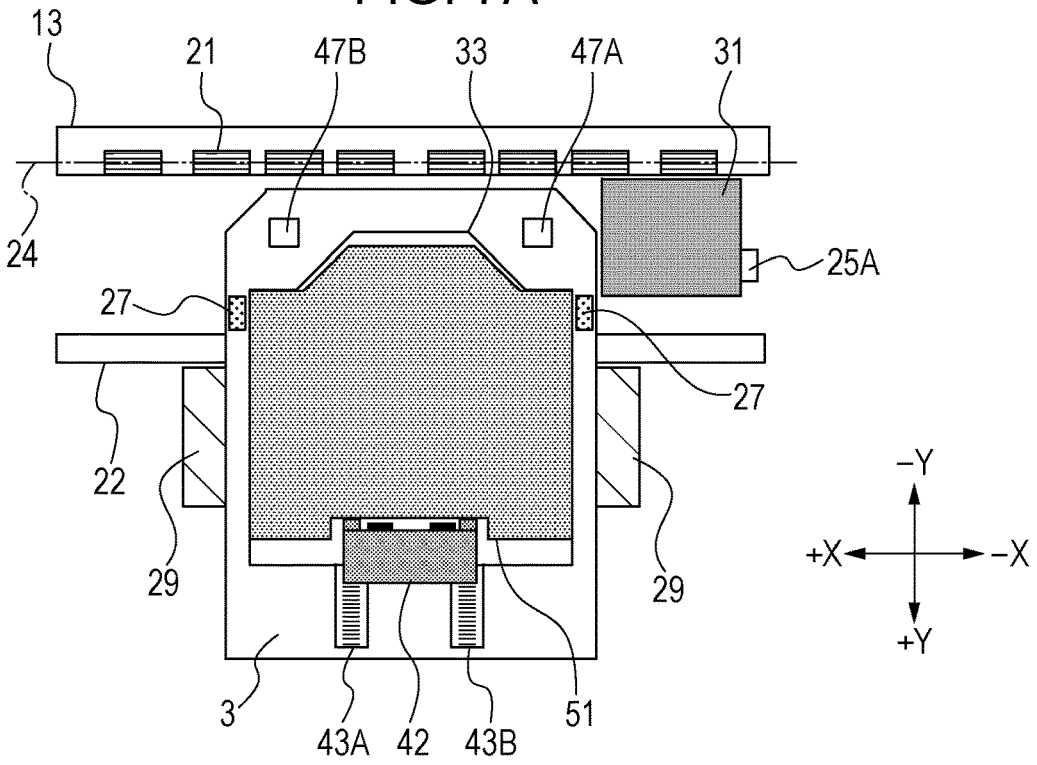
FIGS. 7A and 7B are schematic top views illustrating printing operation with respect to a mount held on the tray according to the first embodiment.
Figure 7B:
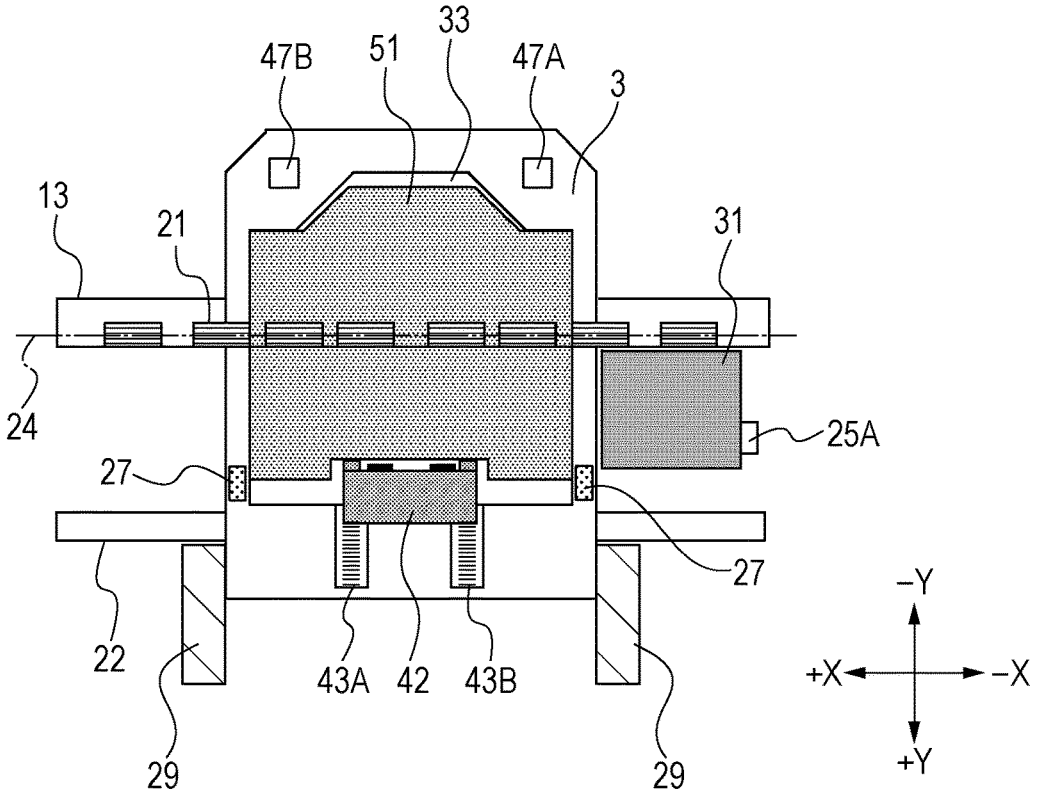

FIGS. 7A and 7B are schematic top views each illustrating a state of printing operation with respect to the mount 52 held on the tray 3. The printing apparatus 1 includes, as conveying units, the first conveyance roller 13 and the second conveyance roller 22. In addition, there are provided a plurality of first follower rollers 21 that are disposed at respective positions opposite the first conveyance roller 13 and that are urged by a spring with respect to the first conveyance roller 13. The printing medium 11 and the tray 3 are held between the first conveyance roller 13 and the first follower rollers 21 and conveyed. A nip formed by the first conveyance roller 13 and the first follower rollers 21 is illustrated as a nip line 24.

The second conveyance roller 22 is disposed on the upstream side of the first conveyance roller 13 in the inserting direction (−Y direction) and is driven together with the first conveyance roller 13 by the conveyance motor 20.

The printing apparatus 1 further includes a spur (not illustrated) that is urged by a spring with respect to the second conveyance roller 22 and that is configured to hold and convey the printing medium 11, such as a paper sheet, in cooperation with the second conveyance roller 22. In addition, separately from the spur, there are provided second follower rollers 27 configured to hold and convey the tray 3 in cooperation with the second conveyance roller 22. The second follower rollers 27 are disposed at two locations so that the tray 3 is held at left and right ends thereof in the X direction. The second follower rollers 27 are disposed at respective positions such that the conveyed tray 3 is held at portions thereof on the outer side of the recessed portion 41.

During conveyance of the printing medium 11, such as a paper sheet, by the second conveyance roller 22, the printing medium 11 and the second follower rollers 27 do not come into contact with each other. During conveyance of the tray 3 by the second conveyance roller 22, the spur is lifted by a guide member 29 configured to guide the tray 3 when the tray 3 is inserted by a user, and the tray 3 and the spur thus do not come into contact with each other.

FIG. 7A illustrates a state in which the tray 3 is inserted in the −Y direction by a user. At this time, the guide member 29 functions as a guide for inserting the tray 3 to a suitable position in the X direction. In other words, the tray 3 is restricted by the guide member 29 from being moved or displaced in the X direction. When the tray 3 is inserted to a predetermined position, the carriage 31 moves, and the optical sensor 25A detects the reflective portions 47A and 47B, thereby detecting the position of the tray 3.

When the optical sensor 25A detects the position of the tray 3, the tray 3 is further taken in in the −Y direction, as illustrated in FIG. 7B, as a result of the rotation of the first conveyance roller 13 and the second conveyance roller 22 and conveyed to a print starting position at which printing by the printing head 12 is started.

Here, due to the pressing member 42 being disposed on the upstream side in the inserting direction (−Y direction), even when the tray 3 is conveyed to the print starting position, the pressing member 42 is positioned on the upstream side of the nip line 24 in the −Y direction. In other words, the pressing member 42 is not held between the first conveyance roller 13 and the first follower rollers 21 during a printing operation with respect to a printing medium held on the tray 3. Consequently, the mount 52 is suppressed from coming off the tray 3 as a result of the pressing member 42 malfunctioning by being held between the first conveyance roller 13 and the first follower rollers 21. When the printing operation is completed, the printing medium is taken out from the tray 3 by a user, and consequently, a printed material is produced.

Such a configuration in which the pressing member 42 is disposed on the upstream side in the inserting direction of the tray 3 and urges a printing medium, such as the mount 52, toward the downstream side in the inserting direction and holds the printing medium achieves conveyance of the tray 3 that reliably holds a printing medium.

A form in which, after the tray 3 is inserted and taken in in the −Y direction from the front side of the printing apparatus 1, printing is performed while conveying the tray 3 in the +Y direction has been described as an example; however, the inserting direction of the tray 3 is not limited thereto. In other words, by disposing the pressing member 42 on the downstream side in the inserting direction (+Y direction), the same effect is obtained also in a form in which the tray 3 is inserted in the +Y direction from the back side of the printing apparatus 1 and in which printing is performed in the +Y direction.

Figure 8A:
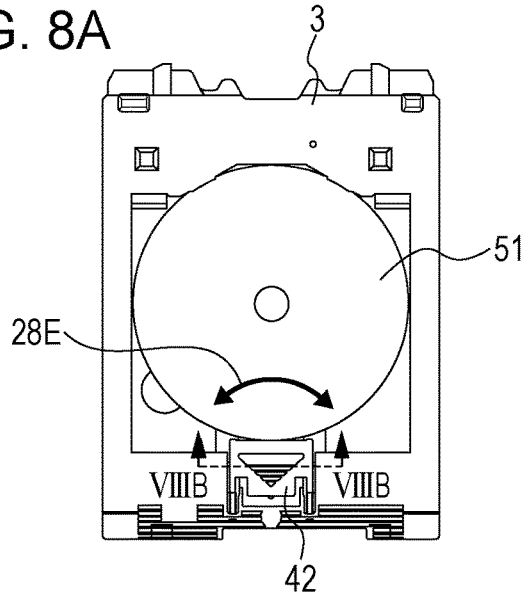
FIGS. 8A, 8B, 8C, 8D, and 8E each describe a detailed configuration of a pressing member according to the first embodiment.
Figure 8B:
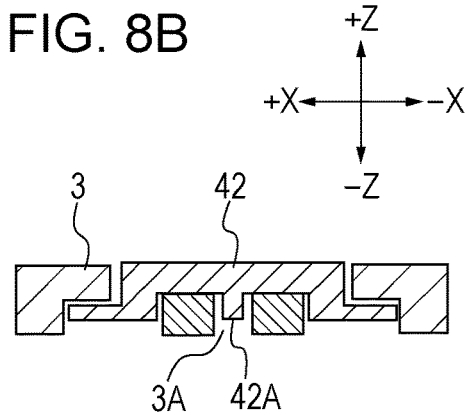
Figure 8C:
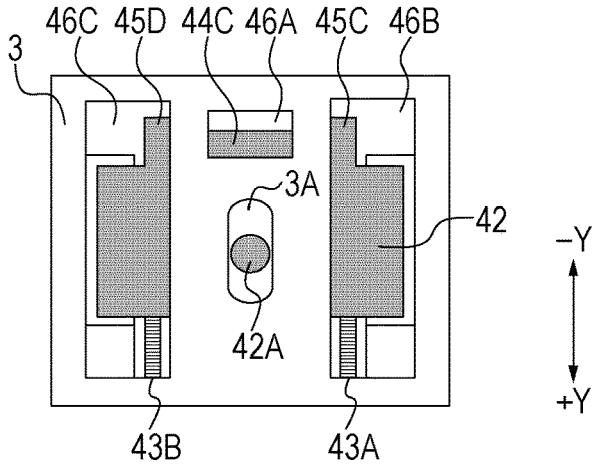

Next, a detailed configuration of the pressing member 42 will be described with reference to FIGS. 8A, 8B, 8C, 8D, and 8E. FIG. 8A is a top view of the tray 3 that holds the disc 51. FIG. 8B is a sectional view of the pressing member 42 sectioned along the line VIIIB-VIIIB of FIG. 8A. FIG. 8C is an enlarged view of the pressing member 42 viewed from the rear side (the side on which a printing medium is not to be placed) of the tray 3.

As illustrated in FIG. 8C, the pressing member 42 is held so as to be rotatable with respect to the tray 3 due to a boss 42A being engaged, so as to be slidable in the Y direction, with an engaging hole 3A disposed in the tray 3. The rotation direction of the pressing member 42 with respect to the tray 3 is the direction of the arrow 28E illustrated in FIG. 8A. The engaging hole 3A is formed to be larger than the boss 42A in the X direction (refer to FIG. 8B) to provide a backlash so that the boss 42A is movable also in the X direction in the engaging hole 3A in accordance with the rotation of the pressing member 42.

In addition, the elastic members 43A and 43B are disposed at respective positions in the tray 3 so as to be bilaterally symmetrical to each other with the boss 42A as the center. The elastic members 43A and 43B connect the tray 3 and the pressing member 42 to each other and urge the pressing member 42 in the −Y direction. Consequently, when the disc 51 is not placed at a suitable position, equalization is performed by the elastic force of the left and right elastic members 43A and 43B such the disc 51 is positioned at the suitable position.

Figure 8D:
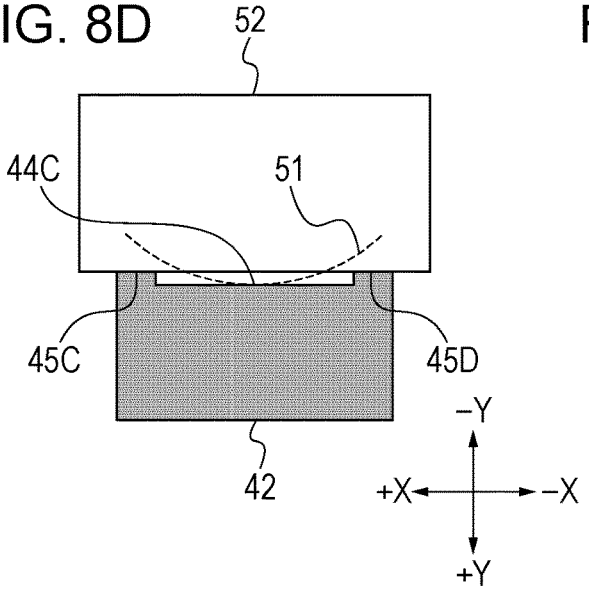

FIG. 8D is a schematic top view of the pressing member 42 that presses the mount 52. For description, the position of the disc 51 while the pressing member 42 presses the mount 52 is indicated by a broken line in FIG. 8D. FIG. 8D illustrates a state of abutting of the mount 52 against the upstream-side second regulating portions 45C and 45D. In the pressing member 42, the upstream-side second regulating portions 45C and 45D are disposed with the upstream-side first regulating portion 44C therebetween. The upstream-side second regulating portions 45C and 45D are disposed at respective positions so as not to be in contact with the outer edge of the disc 51 illustrated by the broken line and each have a shape projecting from the upstream-side first regulating portion 44C in the −Y direction.

Figure 8E:
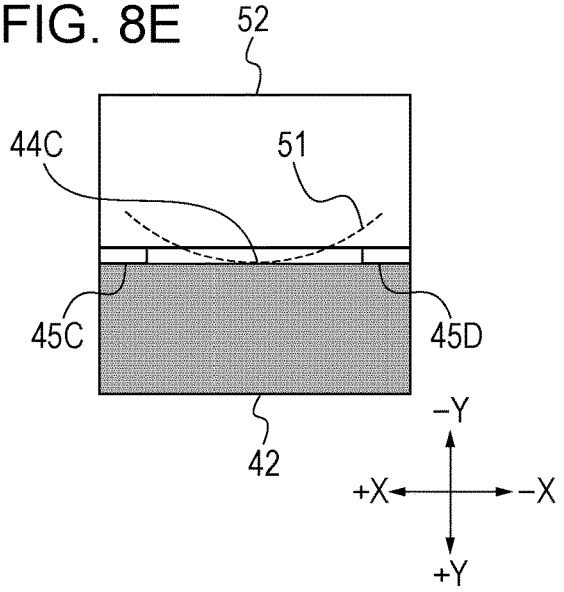

FIG. 8E illustrates a modification of FIG. 8D, as an alternative to the upstream-side second regulating portions 45C and 45D that project in the −Y direction, an area of the mount 52 against which the upstream-side second regulating portions 45C and 45D are abutted projects in the +Y direction.

As described above, to enable the disc 51 and the mount 52 to be placed and held in the recessed portion 41, which is a placement surface, the tray 3 includes the slidable pressing member 42 and the regulating portions that individually correspond to the disc 51 or the mount 52 pressed by the pressing member 42. Consequently, printing media of different types are enabled to be placed on the tray 3 without the need to increase the thickness or the size of the tray 3.

Figure 9A:
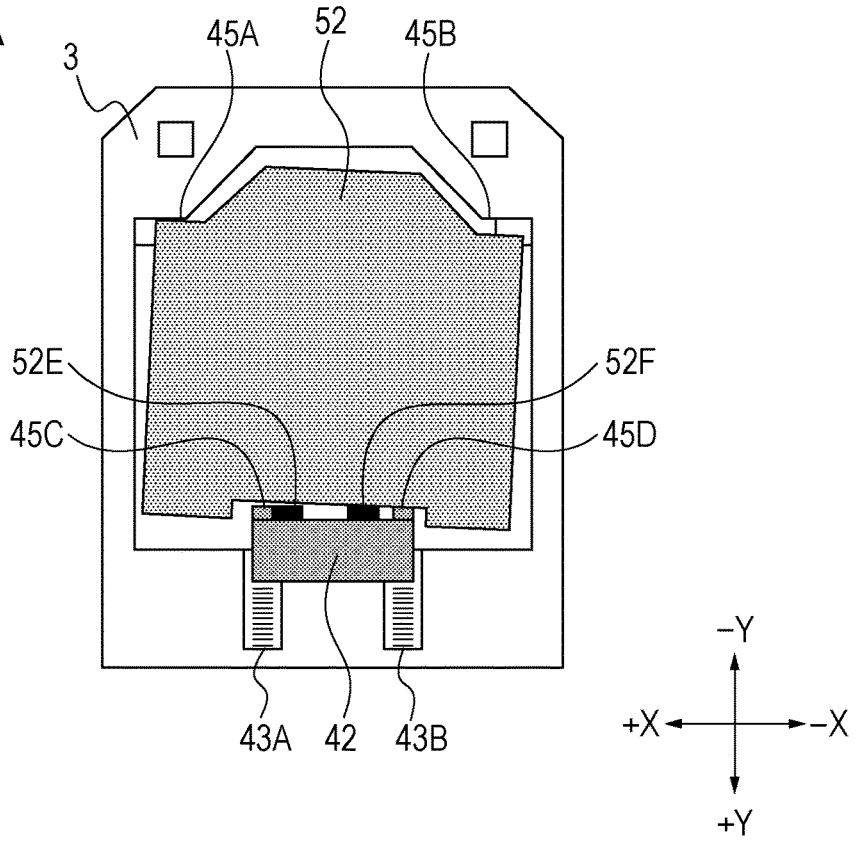
FIGS. 9A and 9B each describe an equalizing function of the pressing member according to the first embodiment.
Figure 9B:
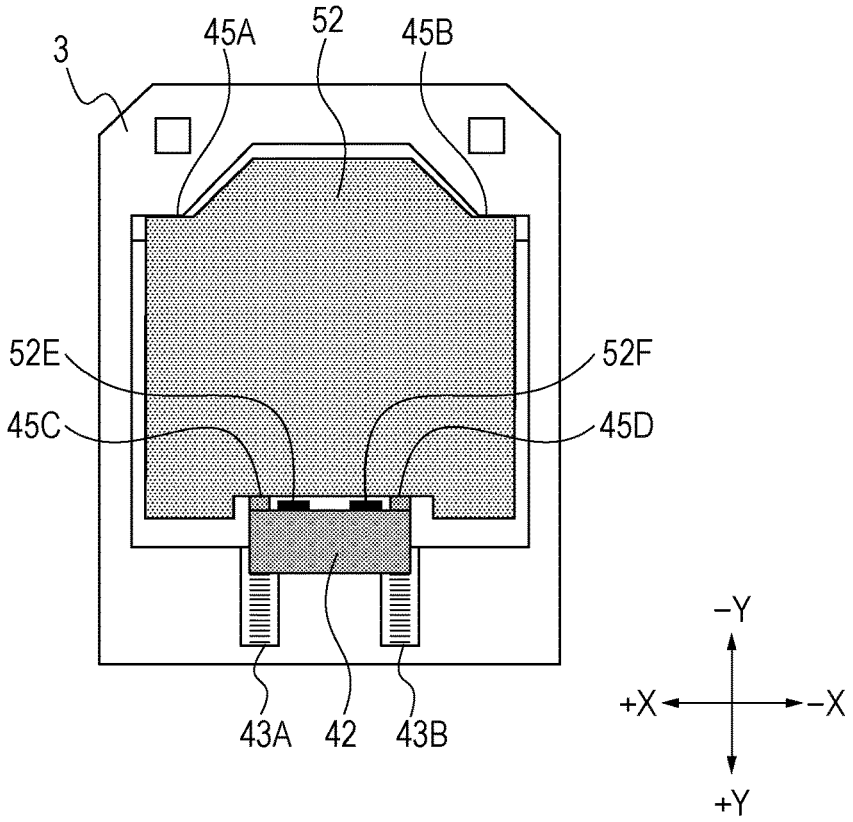

With reference to FIGS. 9A and 9B, the equalizing function of the pressing member 42 will be described. FIG. 9A illustrates a state in which the mount 52 is not suitably placed by a user. At this time, the mount 52 is not abutted against the downstream-side second regulating portion 45B of the tray 3 and is not normally positioned with respect to the tray 3. Thus, if the user inserts the tray 3 in this state into the printing apparatus 1, there is a possibility of printing being performed at a position displaced from a desired printing position.

In such a circumstance, in the tray 3 according to the present embodiment, a load that is stronger than a load applied to the elastic member 43A disposed on the left side is applied to the elastic member 43B disposed on the right side, which causes an urging force that resists the load to be generated in the elastic member 43B. Due to the urging force of the elastic member 43B, the pressing member 42 moves until the elastic forces of the elastic member 43A and the elastic member 43B balance each other. Due to the movement of the pressing member 42, the mount 52 disposed at an unsuitable position is abutted against the downstream-side second regulating portion 45B and suitably positioned (refer to FIG. 9B) as a result of, for example, being rotated and moved.

Figure 10:
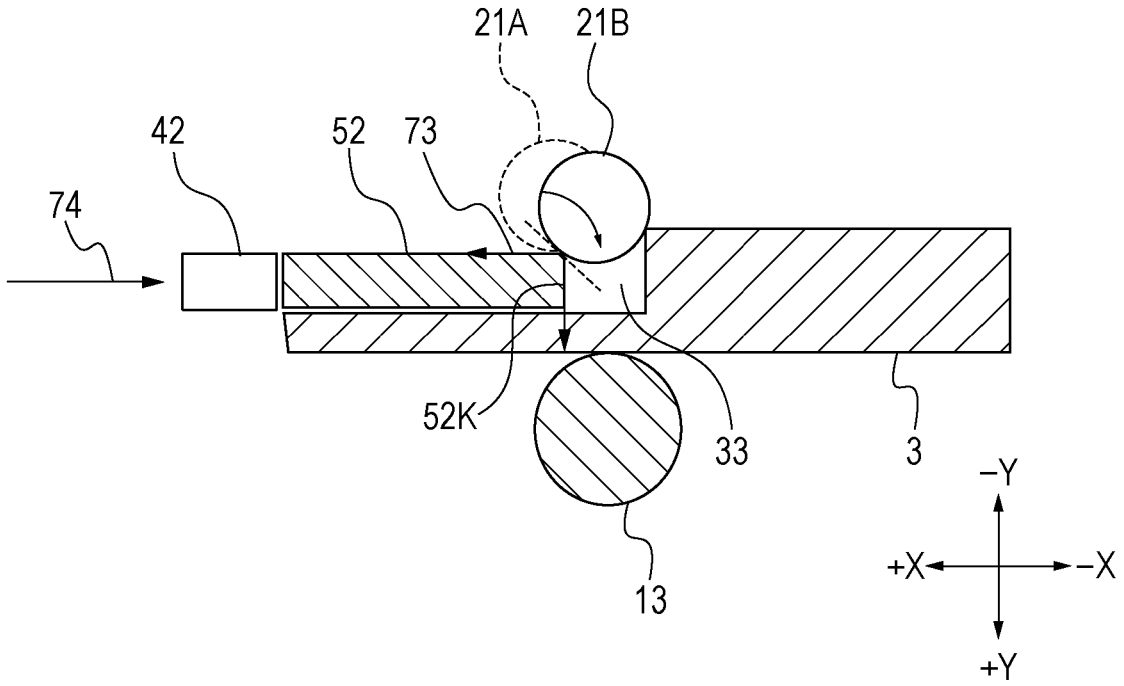
FIG. 10 is a sectional view schematically describing a leading end portion of the mount according to the first embodiment.

Next, with reference to FIGS. 5A, 5B, and 5C and FIG. 10, a leading end portion 52K of the mount 52 will be described. FIG. 10 is a sectional schematic view illustrating a state of the leading end portion 52K (FIG. 5B) of the mount 52 placed on the tray 3 being held between the first conveyance roller 13 and the first follower rollers 21. The leading end portion 52K is a portion of the mount 52 having a shape projecting in the inserting direction. The recessed portion 41 of the tray 3 also includes a projecting portion 41K (FIG. 5A) projecting in the inserting direction so as to correspond to the shape of the leading end portion 52K. When the mount 52 is positioned on the tray 3, a gap 33 is formed between the tray 3 and the mount 52 to allow a tolerance of the external dimensions of the mount 52. During conveyance of the tray 3 by the first conveyance roller 13, if the first follower rollers 21 drop into the gap 33, the position of the mount 52 with respect to the tray 3 is displaced. In FIG. 10, 21A indicates the position of the first follower rollers 21 that suitably holds the tray 3 (and the mount 52), and 21B indicates the position of the first follower rollers 21 that has dropped into the gap 33 between the tray 3 and the mount 52.

The first follower rollers 21 that have dropped to the position of 21B is in contact with an end portion of the mount 52. At this time, the first follower rollers 21 are urged with respect to the first conveyance roller 13 by the spring, and thus, a component force 73 of the urging force of the spring is generated in a direction that resists an urging force 74 received by the pressing member 42. Thus, when the relationship in which "component force 73 with which the first follower rollers 21 urge the mount 52" is greater than "urging force 74 with which the pressing member 42 urges the mount 52" is satisfied, the mount 52 is moved in the +Y direction.

Figure 11:
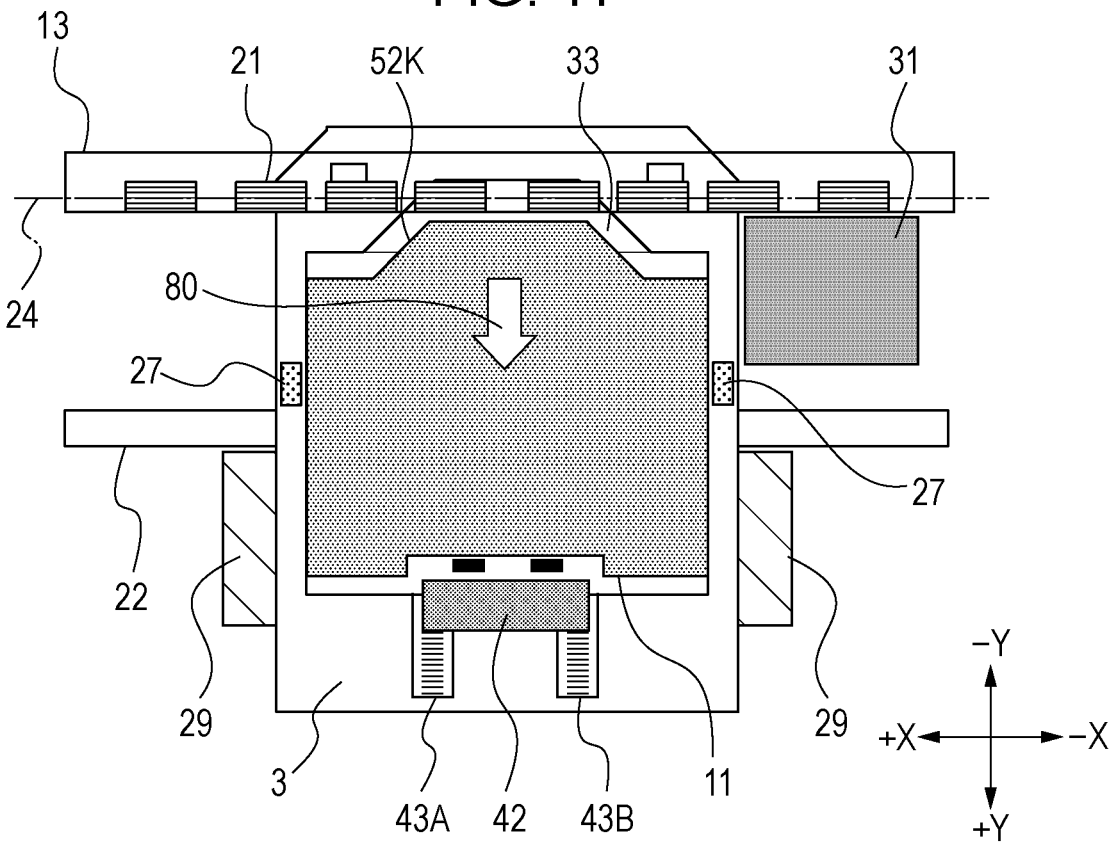
FIG. 11 describes a function of the leading end portion of the mount according to the first embodiment.

FIG. 11 is a schematic top view illustrating conveyance of the tray 3 when the mount 52 projects from the surface of the tray 3 in a state in which the mount 52 is placed on the tray 3 due to a large thickness of the mount 52. When the mount 52 projects, the aforementioned condition is easily satisfied, and the mount 52 is moved in the direction of the arrow 80 with respect to the tray 3. Consequently, a printing misalignment in which a printing position is displaced or the like may be generated.

To suppress the mount 52 from being thus moved by the first follower rollers 21, the height of at least the leading end portion 52K of the mount 52 is formed to be lower than the surface of the tray 3 in a state of being placed in the recessed portion 41 (refer to FIG. 10). Consequently, it is possible to suppress contact between the mount 52 and the first follower rollers 21 and also suppress the mount 52 from moving.

Moreover, in the present embodiment, the leading end portion 52K is formed such that the gap 33 between the tray 3 and the mount 52 is not parallel to the nip line 24 formed by the first conveyance roller 13 and the first follower rollers 21. If the leading end portion 52K is not formed, the nip line 24 and the gap 33 are parallel to each other. Thus, a positional relationship is such that conveyance of the tray 3 causes the plurality of first follower rollers 21 to face the gap 33 at the same timing. In this case, the component force 73 of the first follower rollers 21 acts with respect to the entire width area of the mount 52 in the X direction, which easily causes a positional displacement of the mount 52.

Figure 12A:
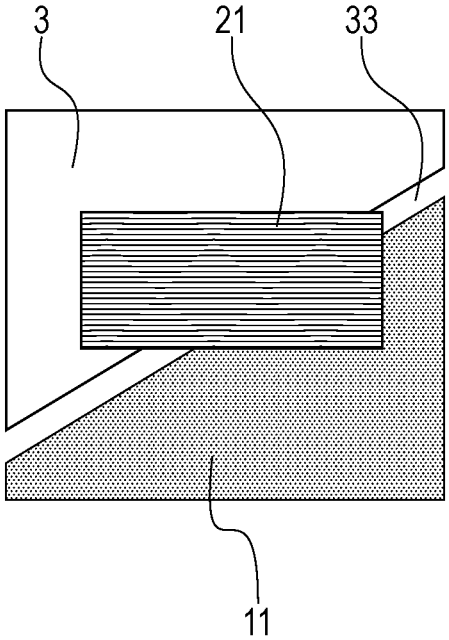
FIGS. 12A, 12B, and 12C each illustrate a positional relationship between first follower rollers according to the first embodiment and a gap.

FIG. 12A is an enlarged top view illustrating a positional relationship between the gap 33 and the first follower rollers 21. As illustrated in FIG. 12A, the first follower rollers 21 (nip line 24) and the gap 33 are formed so as to intersect each other as a result of the leading end portion 52K that extends on the downstream side in the inserting direction (−Y direction) being formed in the mount 52. Consequently, conveyance of the tray 3 causes the gap 33 to gradually enter with respect to the nip line 24, and the component force 73 applied to the mount 52 is thus dispersed, which suppresses positional displacement of the mount 52.

Figure 12B:
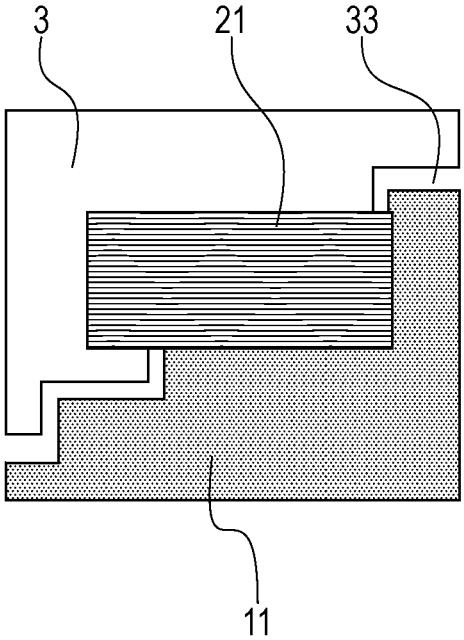
Figure 12C:
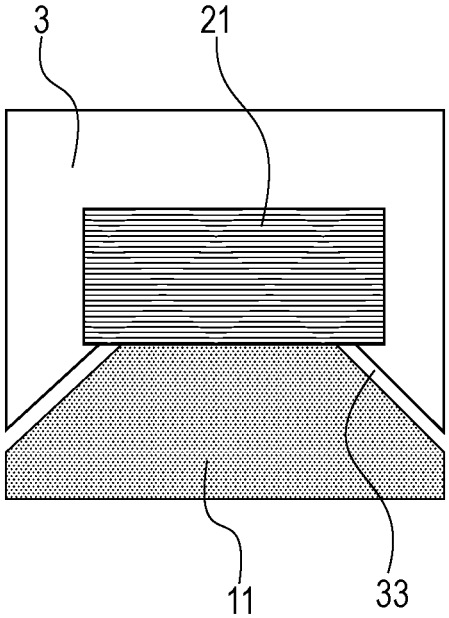

FIG. 12B and FIG. 12C are enlarged top views each illustrating, similarly to FIG. 12A, a positional relationship between the gap 33 and the first follower rollers 21 and each illustrate a modification. The same effect is obtained in such a form in which the gap 33 intersects with respect to the first follower rollers 21.

Figure 13:
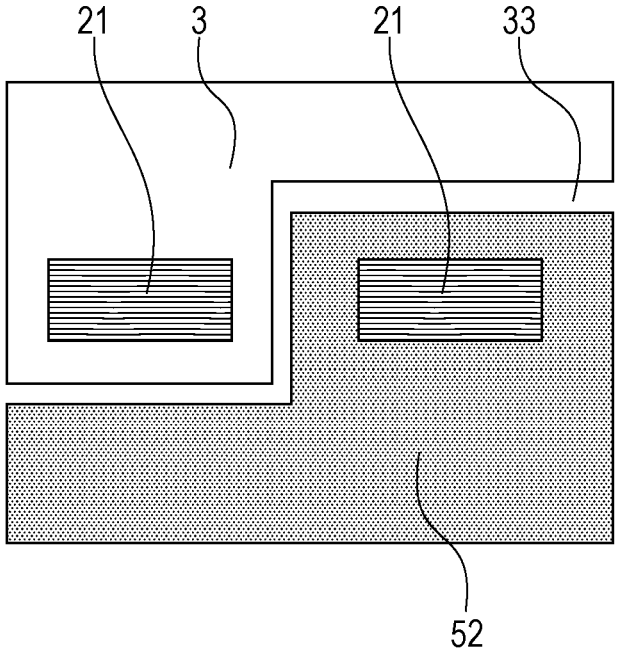
FIG. 13 illustrates a positional relationship between a gap and the first follower rollers according to the first embodiment.

In the present embodiment, a form that includes a plurality of the first follower rollers 21 is presented as an example; however, the present embodiment is a non-limiting example, and a form that includes a single first follower roller 21 may be employed. When the tray 3 is conveyed in the form that includes a plurality of the first follower rollers 21, rollers that hold therebetween the body of the tray 3 and rollers that hold therebetween a printing medium, such as the mount 52, may be arranged so as to be necessarily present, as illustrated in FIG. 13. Consequently, it is possible to further suppress the positional displacement of the mount 52.

The present invention has been described above by presenting, as an example, a printing apparatus that uses an ink jet system; however, the present invention is also applicable to an image forming apparatus that uses an electrographic system.

Second Embodiment

In a second embodiment, a configuration of the tray 3 that suppresses, on the upstream side in the inserting direction (−Y direction) of the tray 3, floating of the mount 52 also at the two end portions in the X direction, differently from the first embodiment.

Description of configurations common to the first embodiment will be omitted.

Figure 14A:
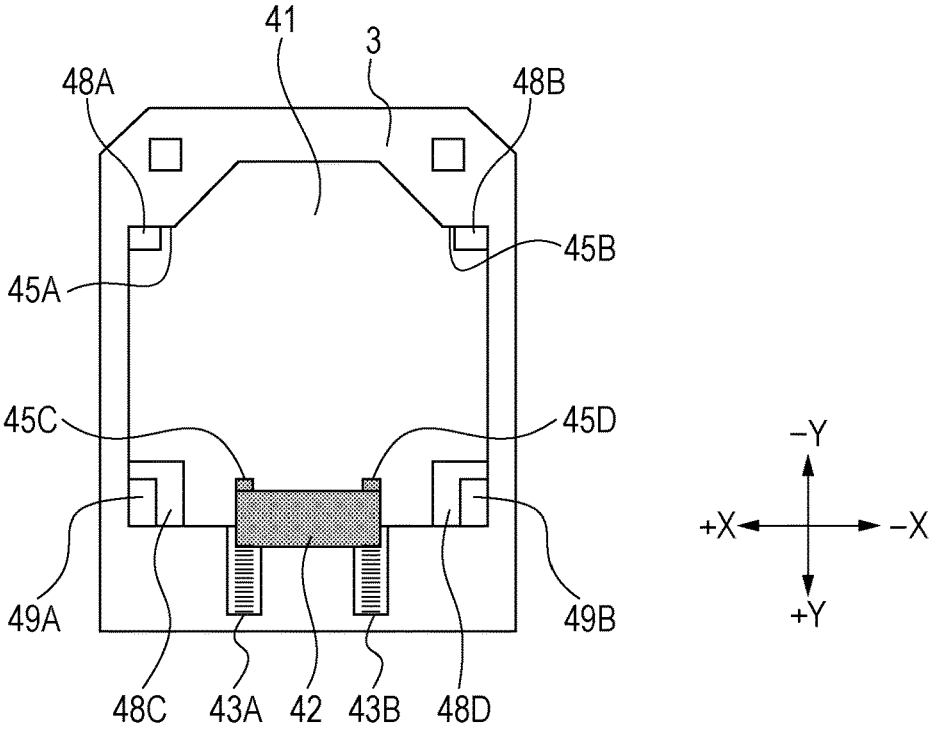
FIGS. 14A and 14B each describe a configuration of the mount and the tray according to a second embodiment.
Figure 15:
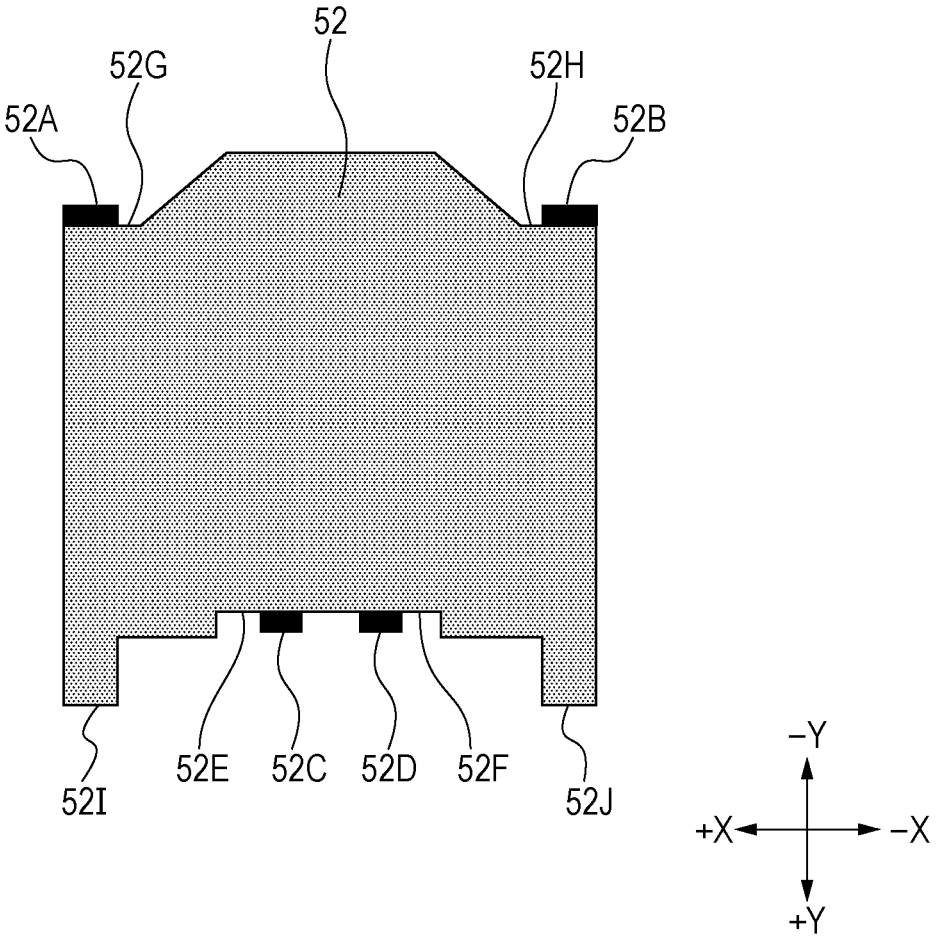
FIG. 15 describes a configuration of the mount according to the second embodiment.

FIG. 14A is a top view of the tray 3 that includes mount holding portions 49A and 49B at the two end portions in the X direction on the upstream side in the inserting direction. In the vicinity of the mount holding portions 49A and 49B, openings 48C and 48D are disposed, respectively. FIG. 15 illustrates the mount 52 applicable to the tray 3 illustrated in FIG. 14A. The mount 52 includes a protrusion 521 that is insertable into the opening 48C and a protrusion 52J that is insertable into the opening 48D. The protrusions 521 and 52J inserted into respective openings are additionally restricted by the mount holding portions 49A and 49B from floating, which reliably prevents the mount 52 from floating from the tray 3.

Figure 14B:
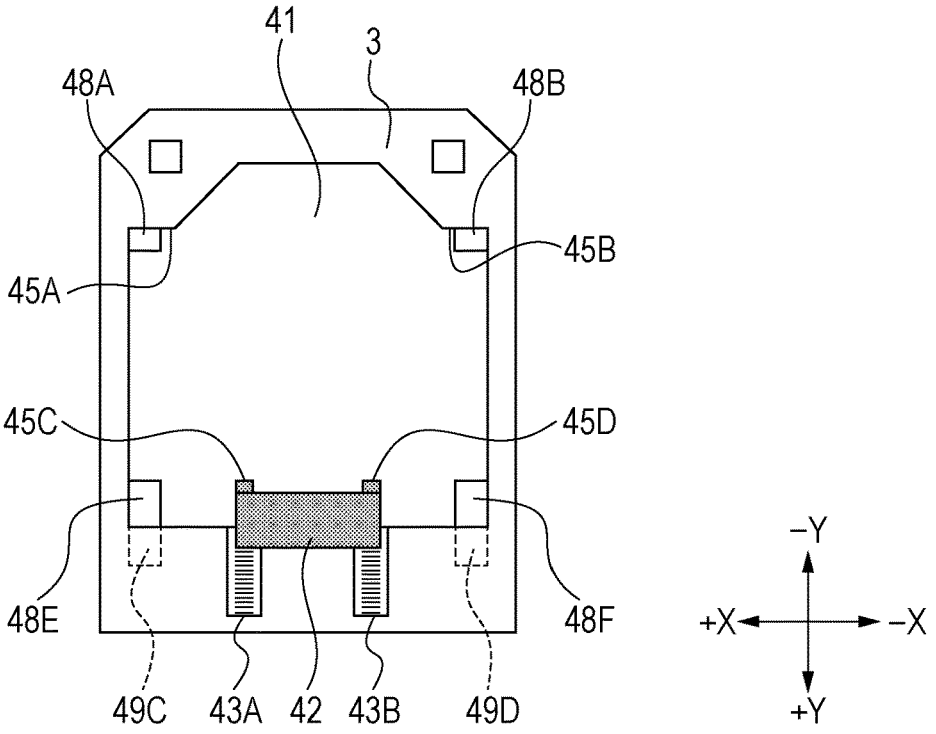

FIG. 14B is a modification of that in FIG. 14A and illustrates a configuration that includes spaces into which the protrusions 521 and 52J corresponding thereto are insertable to broken-line parts 49C and 49D, respectively, on the back side of the tray 3. The same effect as that in FIG. 14A is obtained.

Third Embodiment

Figure 16A:
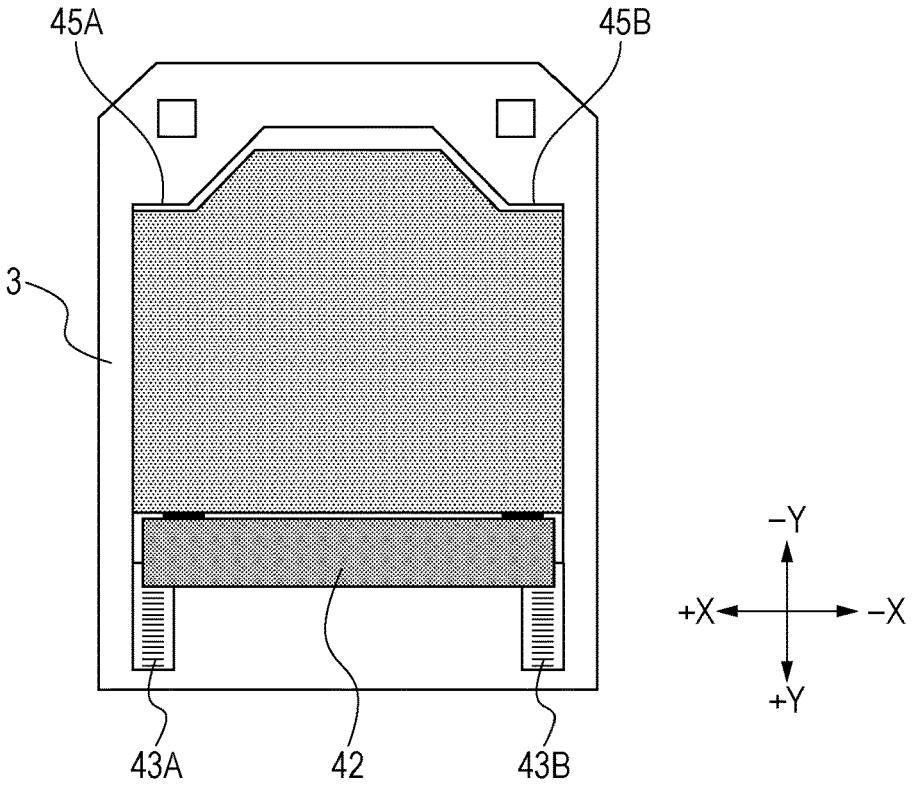
FIGS. 16A and 16B each describe a configuration of the mount and the tray according to a third embodiment.
Figure 16B:
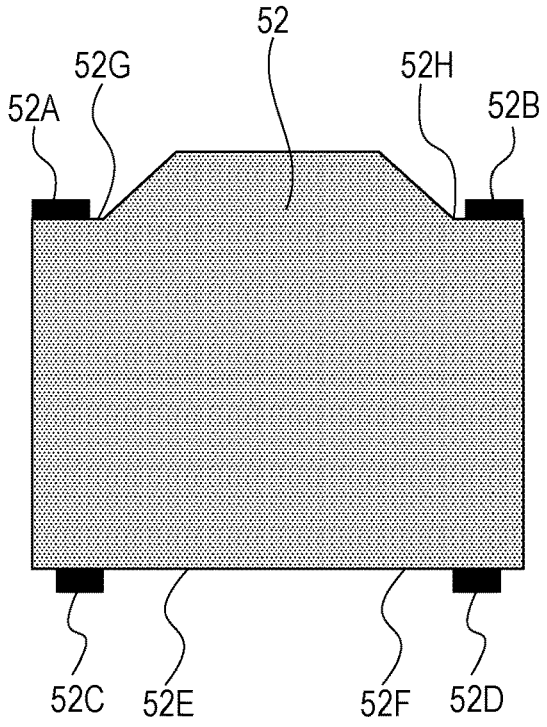

With reference to FIGS. 16A and 16B, a third embodiment will be described. As illustrated in FIG. 16A, in the third embodiment, the pressing member 42 extends by a degree corresponding to the width of the mount 52 in the X direction. FIG. 16B illustrates the mount 52 applicable in FIG. 16A, the mount 52 including the third protrusion 52C and the fourth protrusion 52D that are disposed closer, than in the first embodiment, to the end portions in the X direction. Consequently, the third protrusion 52C and the fourth protrusion 52D are respectively inserted into the first engaging portion 45E and the second engaging portion 45F of the pressing member 42, and it is thus possible to further suppress the mount 52 from floating, compared to the first embodiment.

In other words, the present invention provides a tray that reliably holds an adapter that allows a printing medium to be placed thereon.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-145041 filed Aug. 1, 2018, which is hereby incorporated by reference herein in its entirety.

What is claimed is:

1. A tray to hold a printing medium and that is to be used in a printing apparatus, wherein the printing apparatus includes a conveying unit configured to convey the tray holding the printing medium, and includes a printing unit configured to perform printing onto a print surface of the printing medium held by the tray, the tray comprising:

a placement surface capable of receiving an adapter configured to hold the printing medium to be placed thereon;

a pressing member disposed on an upstream side in an inserting direction of the tray with respect to the printing apparatus and configured to press the adapter placed on the placement surface toward a downstream side in the tray inserting direction;

a regulating portion configured to regulate a movement of the adapter placed on the placement surface by abutting an abutting surface of the adapter pressed by the pressing member; and an engaging portion capable of receiving a protrusion of the adapter in a case where the protrusion is inserted into the engaging portion along the tray inserting direction.

2. The tray according to claim 1, wherein the regulating portion includes a first regulating portion and a second regulating portion, and wherein an opening of the tray into which the protrusion is insertable includes a first opening disposed adjacent to the first regulating portion in a width direction crossing the tray inserting direction and a second opening disposed adjacent to the second regulating portion in the width direction.

3. The tray according to claim 2, wherein the first opening and the second opening are disposed, on the placement surface, on the downstream side in the tray inserting direction.

4. The tray according to claim 1, wherein the engaging portion is a first engaging portion, the protrusion includes a first protrusion and a second protrusion, and the pressing member includes a second engaging portion into which the second protrusion of the adapter is insertable.

5. The tray according to claim 1, the tray further comprising an elastic member that rotatably connects the pressing member to the tray.

6. The tray according to claim 1, wherein the placement surface includes a projecting surface that projects in the tray inserting direction.

7. The tray according to claim 1, wherein the printing medium includes a nail sticker disposed on the adapter.

8. The tray according to claim 1, wherein the printing medium includes a card, and the adapter includes a card placement surface that allows the card to be placed on the card placement surface.

9. The tray according to claim 1, wherein the placement surface allows a circular disc to be placed on the placement surface.

10. The tray according to claim 1, wherein the printing unit includes a printing head configured to print an image by discharging ink.

11. An adapter that is to be used in a printing apparatus, wherein the printing apparatus includes a conveying unit configured to convey a tray that holds a printing medium, and includes a printing unit configured to perform printing onto a print surface of the printing medium held by the tray, the adapter comprising:

a protrusion; and an abutting surface, wherein the adapter is configured to be placed in a placement surface of the tray to hold the printing medium, wherein the adapter placed on the placement surface is configured to be pressed by a pressing member of the tray toward a downstream side in an inserting direction of the tray, wherein the pressing member is disposed on an upstream side in the tray inserting direction with respect to the printing apparatus, wherein, in a case where the adapter, placed on the placement surface and pressed by the pressing member, moves, movement of the adapter is regulated by the abutting surface of the adapter being abutted by a regulating portion of the tray, and wherein the protrusion of the adapter is configured to be received by an engaging portion of the tray in a case where the protrusion is inserted into the engaging portion along the tray inserting direction.

12. The adapter according to claim 11, wherein the protrusion includes a first protrusion disposed at a first end of the adapter in a width direction crossing the tray inserting direction, and a second protrusion disposed at a second end of the adapter in the width direction.

13. The adapter according to claim 12, wherein the first protrusion and the second protrusion are disposed on the downstream side in the tray inserting direction in a state of being placed on the tray.

14. The adapter according to claim 11, the adapter further comprising a third protrusion that is insertable into an engaging portion of the pressing member.

15. The adapter according to claim 11, the adapter further comprising a leading end portion that projects in the tray inserting direction in a state of being placed on the tray.

16. The adapter according to claim 11, wherein the printing medium includes a nail sticker.

17. The adapter according to claim 11, wherein the printing medium includes a card, and the adapter comprises a card placement surface configured to allow the card to be placed on the card placement surface.

18. The adapter according to claim 11, wherein the printing unit includes a printing head configured to print an image by discharging ink.

19. A printing system comprising:

a tray to hold a printing medium; and a printing apparatus having a conveying unit configured to convey the tray holding the printing medium, and having a printing unit configured to perform printing onto a print surface of the printing medium held by the tray, wherein the tray includes:

a placement surface capable of receiving an adapter configured to hold the printing medium to be placed thereon, a pressing member disposed on an upstream side in an inserting direction of the tray with respect to the printing apparatus and configured to press the adapter placed on the placement surface toward a downstream side in the tray inserting direction, a regulating portion configured to regulate a movement of the adapter placed on the placement surface by abutting an abutting surface of the adapter pressed by the pressing member, and an engaging portion capable of receiving a protrusion of the adapter in a case where the protrusion is inserted into the engaging portion along the tray inserting direction.

20. The printing system according to claim 19, wherein the printing unit includes a printing head configured to print an image by discharging ink.

* * * * *